United States Patent [19]

Mazur

[11] 4,238,911

[45] Dec. 16, 1980

[54] TELESCOPING COLUMNS

[76] Inventor: Robert A. Frosch, Administrator of the National Aeronautics and Space Administration, with respect to an invention of John T. Mazur, Sebastian, Fla.

[21] Appl. No.: 946,991

[22] Filed: Sep. 29, 1978

[51] Int. Cl.[3] ..... E04H 12/18

[52] U.S. Cl. ..... 52/111; 52/632; 182/62.5; 212/267

[58] Field of Search ..... 52/111, 110, 118, 121, 52/632; 182/62.5, 63, 141; 343/901, 903; 212/55; 214/141

[56] References Cited

U.S. PATENT DOCUMENTS

| | | | |
|---|---|---|---|
| 160,485 | 3/1875 | Thomas et al. | 52/111 X |
| 1,250,108 | 12/1917 | Seymour | 182/141 |
| 1,286,807 | 12/1918 | Seymour | 52/111 |
| 2,576,389 | 11/1951 | Craighead et al. | 182/63 X |
| 3,106,299 | 10/1963 | Pingon | 52/111 X |
| 3,296,757 | 1/1967 | Goodman | 52/111 |
| 3,556,250 | 1/1971 | Miele | 182/141 X |
| 3,777,629 | 12/1973 | Johnston et al. | 212/55 X |
| 3,807,108 | 4/1974 | Johnston | 212/55 X |
| 4,062,156 | 12/1977 | Roth | 52/111 |
| 4,125,974 | 11/1978 | Kay et al. | 212/55 X |

*Primary Examiner*—Stephen J. Novosad

*Attorney, Agent, or Firm*—Howard J. Osborn; John R. Manning

[57] ABSTRACT

An extendable column consisting of a plurality of axially elongated rigid structural sections nested within one another. Each section includes a plurality of screws running the length thereof and rotatably attached therein. The next inner section includes threaded lugs oriented to threadingly engage the screws thus resulting in extension or retraction of the column upon rotation of the screws. The screws of each section are selectively rotated by a motor and an engagement mechanism.

9 Claims, 9 Drawing Figures

TELESCOPING COLUMNS

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; USC 2457).

BACKGROUND OF THE INVENTION

The present invention relates to an extendable column and more particularly to an extendable column utilizing screws to extend and retract a plurality of axially elongated sections which telescope within each other.

In the design of a large deployable parabolic antenna for space application a need arose for an extendable column capable of extending up to ten times its initial length. This capability is necessary to enable the antenna to be collapsed for transport aboard the space shuttle.

A variety of extension designs were investigated, including systems using cables, hydraulics and airjacks, but proved inadequate. In space application the use of hydraulic or airjack systems is precluded by the risk of leaks and subsequent system failure. Cable systems are complex and prone to failure especially in a weightless environment where opposing sets of cables are required.

The present invention utilizes screws to extend sections which telescope within each other. Each section includes a set of screws interconnected by a chain and sprockets to enable simultaneous rotation thereof. Rotation of the screws in one section results in telescoping the next inner section having threaded bosses engaging the screws. The section screws are driven by a common motor being selectively engaged therewith by clutch mechanisms to extend the column to the desired length.

The use of screws to interface the extended section provides excellent structural integrity, low compliant joints, and zero backlash since once extended, the sections are bolted tightly together. Also, the column is capable of supporting both compressive and tensile loads during extension and retraction affording a high degree of safety in operation under loaded conditions.

An object of the present invention is an extendable column capable of extending up to ten times its original length.

A further object of the invention is an extendable column with low compliant joints and zero backlash.

A further object of the invention is an extendable column capable of supporting loads during extension and contraction.

A further object of the invention is an extendable column having a plurality of structural sections which telescope within each other having screws threadingly engaging an adjacent section to extend or retract the column by rotation of the screws.

Another object of the invention is an extendable column which yields the foregoing advantages and which utilizes a single motor and a plurality of clutches to selectively extend or retract the structural sections of the columns.

Another object of the invention is an extendable column which yields the foregoing advantages and which utilizes chains and sprockets to drivingly connect the motor with the clutches.

Other objects and advantages of the present invention will be readily apparent from the following description and drawings which illustrate preferred embodiments of the present invention.

SUMMARY OF THE INVENTION

The present invention involves a power operated telescoping column. The column consists of a plurality of axially elongated rigid structural sections which nest within one another including an outermost, an innermost and a plurality of intermediate sections. The outermost and each intermediate section includes a plurality of screws extending longitudinally therealong and attached thereto. Each screw is rotatable about its axis of symmetry. Sprockets are rigidly attached to the screws and interconnected by a chain to provide simultaneous rotation of the screws of a single section. Threaded lugs are attached at the base end of the section and oriented to engage the screws of the next outer section. The column is extended and rotated by selectively rotating the screws of a section with a motor and an engagement mechanism. As the screws rotate, the next inner section, being threadingly engaged thereto, is extended.

DESCRIPTION OF THE PREFERRED EMBODIMENT

Figure 1:
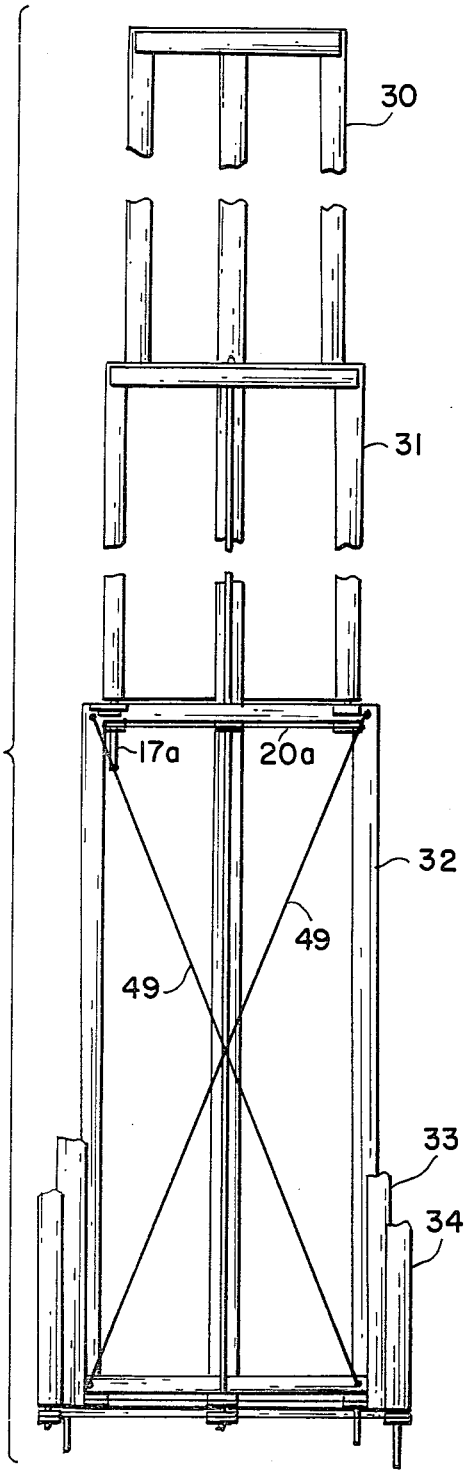
FIG. 1 is a fragmentary side view of an extendable column according to the present invention.

Referring to FIG. 1, the nesting arrangement of the axially elongated sections of the preferred embodiment is shown. For clarity portions of innermost section 30, intermediate sections 31 and 33, and outermost section 34 have been omitted from FIG. 1. Also, the motor and clutch mechanism, being shown in detail in FIG. 2, have been deleted from FIG. 1 for clarity. As shown, sections 30 and 31 are in the fully extended position while sections 32 and 33 are in the fully retracted position. Section 34 is the outermost section composing the base of the column and section 30 is the innermost section composing the tip of the column.

The preferred embodiment, and each section thereof, is equilaterally triangular in cross-section and forms a right triangular configuration. FIG. 1 views one side or face of the column. Diagonal braces 49 extend diagonally across each face of each section, however, for clarity are shown only on section 32 of FIG. 1 and section 31 of FIG. 5.

Figure 2:
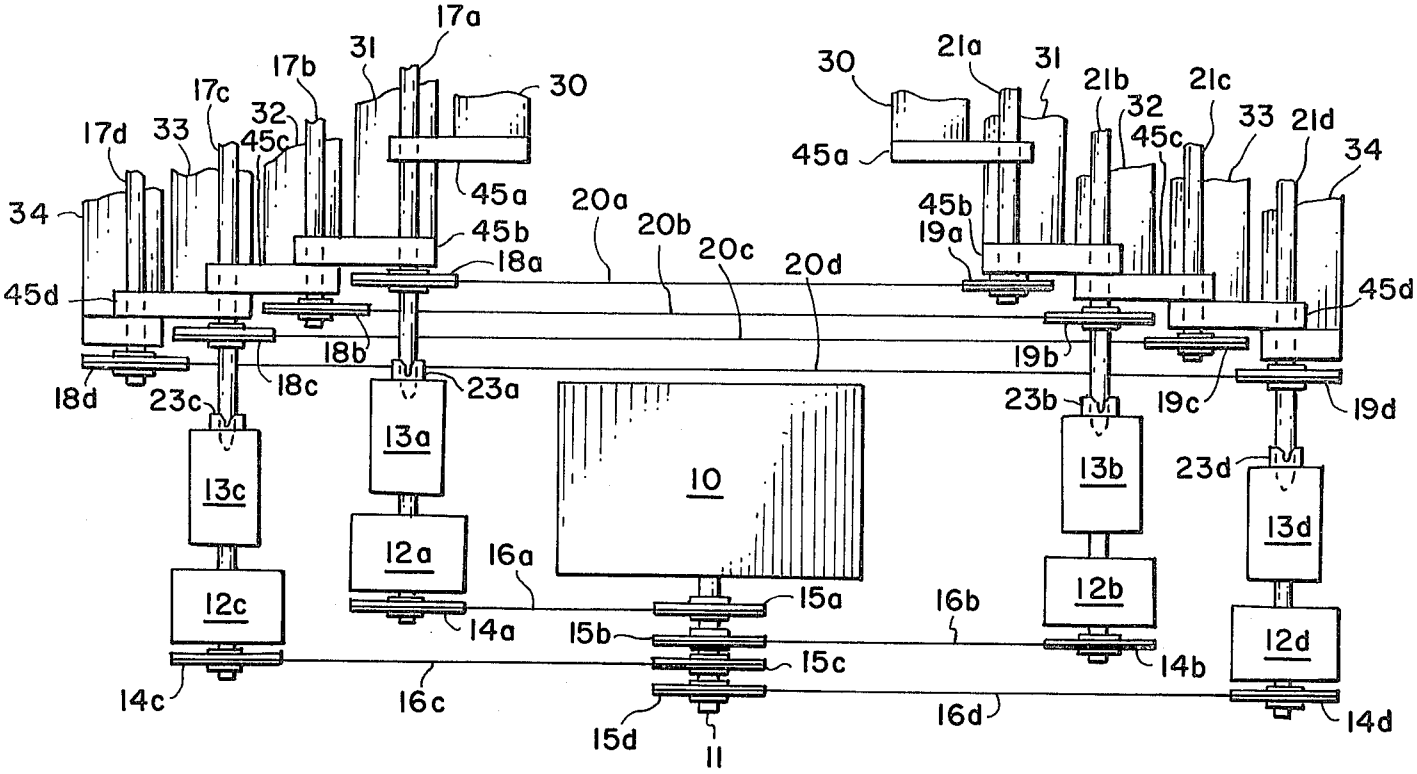
FIG. 2 is a fragmentary side view similar to FIG. 1 showing the motor and engagement mechanisms of the present invention.

Referring now to FIG. 2, the drive motor and clutch mechanism of the preferred embodiment are shown. The outer section 34 and the intermediate sections 31, 32, and 33, each are associated with a separate set of chains and sprockets and a clutch and receiver similar in construction from section to section. Similar parts are hereinafter and in the drawings assigned identical numbers plus a letter to associate them to the corresponding section. The letters a, b, c, and d correspond to sections 31, 32, 33 and 34, respectively. For example, part 12*a*, a clutch, is similar to part 12*c*, but part 12*a* is associated with and acts upon section 31 and other "a" parts, whereas part 12*c* is associated with and acts upon section 33 and other "c" parts. Hereinafter reference to a numeral without the corresponding letter is reference to all the similar parts, e.g., "clutches 12" refers to "clutches 12*a*, 12*b*, 12*c* and 12*d*."

Drive motor 10 turns motor shaft 11 and shaft sprockets 15 attached thereto. Clutch sprockets 14 are rotatably attached to clutches 12 and are drivingly interconnected to shaft sprockets 15 by primary chains 16. Engagers 13 are drivingly connected to clutches 12.

Screws 17, 21, and 24 are positioned at the corners of and extend the length of each section. Sprockets 18, 19 and 27 are fixedly attached at the base end of and share axes of symmetry with screws 17, 21 and 24 respectively. Sprockets 19 and 27 are drivingly interconnected to sprockets 18 by chains 20. Screws 17 extend past the base end of the section to mate with engagers, 13. As shown in FIG. 2, screws 17 extend to meet receivers 23 of engagers 13.

Figure 3:
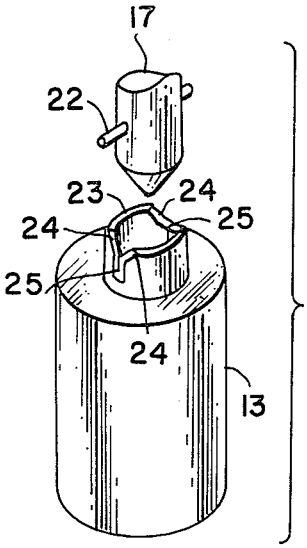
FIG. 3 is a perspective view of a screw engager of the present invention.

Refer now to FIG. 3 which shows screw 17 removed from receiver 23. Receivers 23 are hollow for receiving the end of screws 17 and have tapered edges 24 and slots 25 for receiving pins 22 protruding from screws 17. When screw 17 and receiver 23 are mated, the rotation of engager 13 causes screw 17 to rotate through the engagement of receiver 23 and pins 22.

Figure 9:
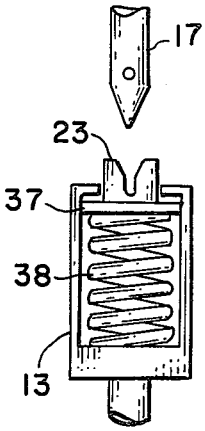
FIG. 9 is a cutaway view of the engager of FIG. 3.

Refer now to FIG. 9, a cutaway view of an engager 13 is shown. Receiver 23 is attached to plate 37 which may slide but not rotate with respect to engager 13 to compress spring 38 positioned inside engager 13. The spring affords the system a degree of flexibility to account for possible variations in screw 17 length or position. Additionally upon retraction of a section, initially, pins 22 may not line up with slots 25 and may contact receiver 23 at the upper edge thus depressing spring 38. Subsequently, upon rotation of engager 13 and receiver 23 relative to screw 17, pins 22 will slip into slots 25 to mate screw 17 with receiver 23.

Referring back to FIG. 2, note that as shown, all screws 17 are mated with engagers 13 and the column is fully retracted except for the innermost section 30 which is partially extended.

Screw 17*a* is drivingly connected to screw 21*a* by drive sprocket 18*a*, driven sprocket 19*a* and secondary chain 20*a*. Screws 17*a* and 21*a* engage threaded lugs 45 of section 30. Similarly, the innermost and each intermediate section in the column has threaded lugs 45 to engage the screws of the corresponding next outer section.

Figure 4:
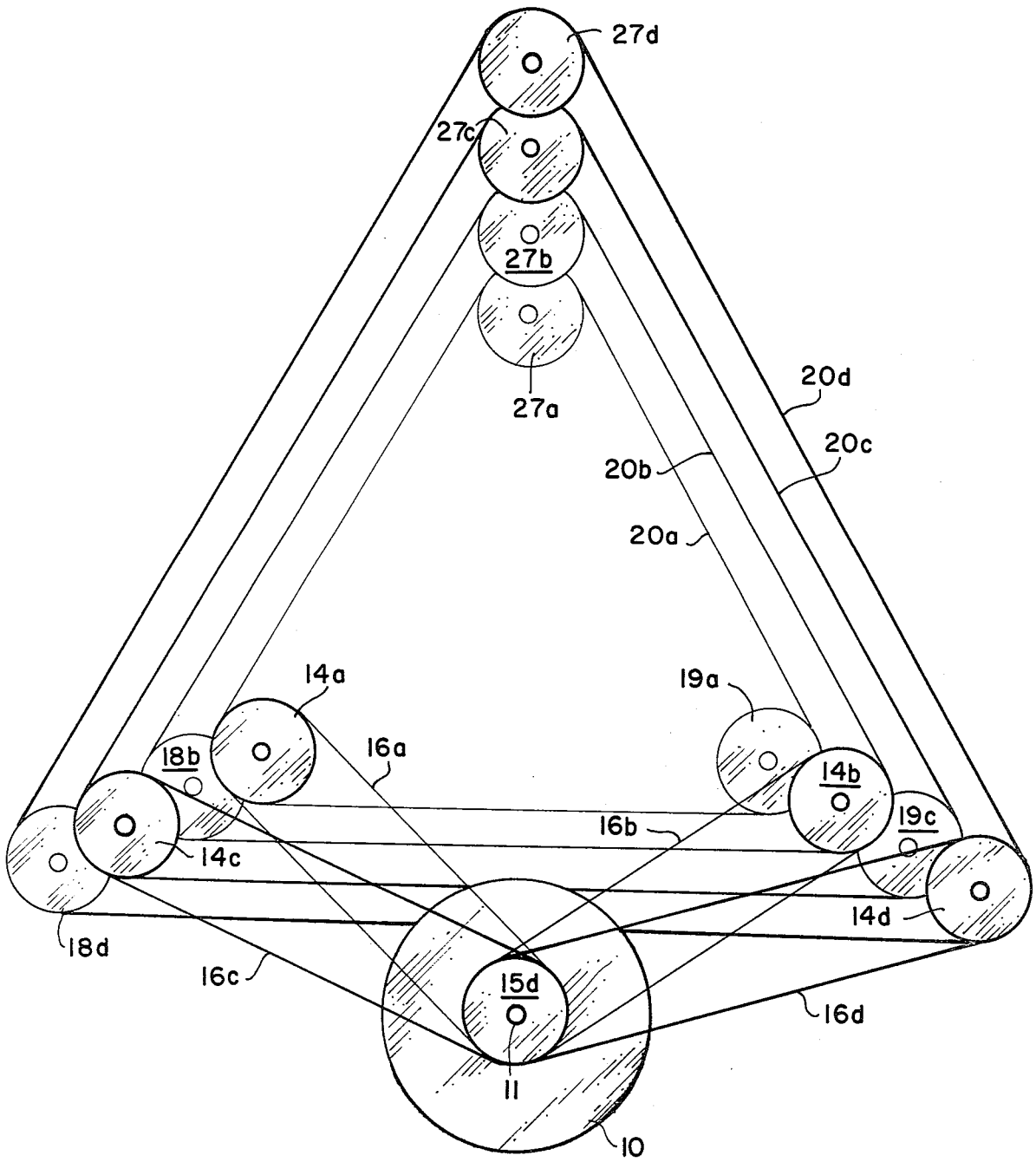
FIG. 4 is a fragmentary base end view similar to FIG. 1 showing a motor, sprocket and chain arrangement of the present invention.

Refer now to FIG. 4 which shows a base end view of the sprockets, chains, and drive motor 10. Motor 10 may be positioned at any convenient location either inside or outside the boundaries of the column. Drive chains 16 drive sprockets 14. The other chains shown are secondary chains 20 which interconnect the sprockets of each of sections 31, 32, 33 and 34.

Figure 5:
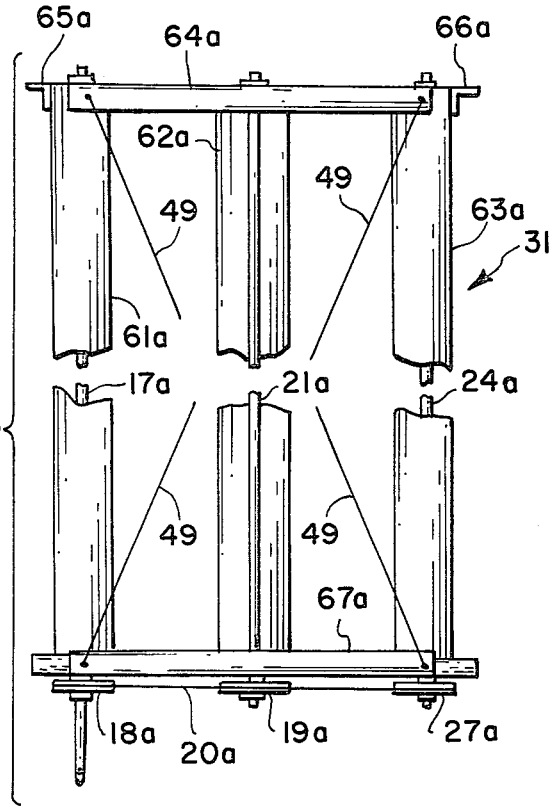
FIG. 5 is a fragmentary side view of an intermediate section of the present invention.

Refer now to FIG. 5, there being shown intermediate section 31. Intermediate sections 32 and 33 are similarly constructed to section 31. Innermost section 30 is similarly constructed to section 31, but lacks screw mechanisms. Outermost section 34 is similarly constructed to section 31, but lacks threaded lugs 45.

Framing members 61*a*, 62*a*, and 63*a* are semicircular tubes concave toward the geometric center of the section. Framing members 64*a*, 65*a* and 66*a* are angle beams rigidly attached to framing members 61*a*, 62*a* and 63*a* of the tip end of section 31 by riveting, welding, or other suitable means. Similarly framing members 67*a*, 68*a* and 69*a* are angles riveted or welded or otherwise rigidly attached to framing members 61*a*, 62*a*, and 63*a* at the base end of section 31. The above mentioned framing members are connected to form a right triangular configuration.

Plates 46*a* (FIG. 6) and lugs 45*a* (FIG. 7) are attached to framing members 61*a*, 62*a* and 63*a* at the tip and base ends respectively to provide plane surfaces perpendicular to the framing members 61*a*, 62*a* and 63*a*.

Threaded screws 17*a*, 21*a*, and 24*a* extend the length of section 31 and extend through and are rotatably attached at the tip end to plates 46*a* and extend through and are rotatably attached at the base end to lugs 45*a*.

Sprockets 18*a*, 19*a*, and 27*a* are rigidly attached to and share an axis of rotation with screws 17*a*, 21*a* and 24*a* respectively and are interconnected by chain 20*a*.

Figure 6:
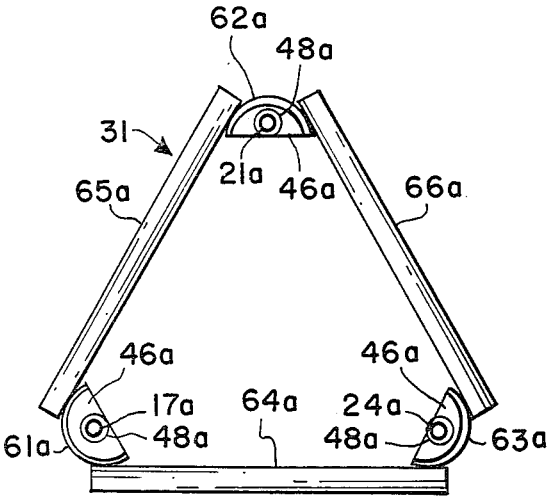
FIG. 6 is a tip end view of the intermediate section of FIG. 5.

FIG. 6 shows a tip end view of section 31. Note the triangular configuration of framing members 64*a*, 65*a* and 66*a*. Also note the orientation of the semicircular framing members 61*a*, 62*a* and 63*a* concave toward the center of section 31. Recirculating ball nuts 48 enable low friction rotation of screws 17*a*, 21*a* and 24*a* within plates 46*a* and preclude the slipping of said screws therethrough.

Figure 7:
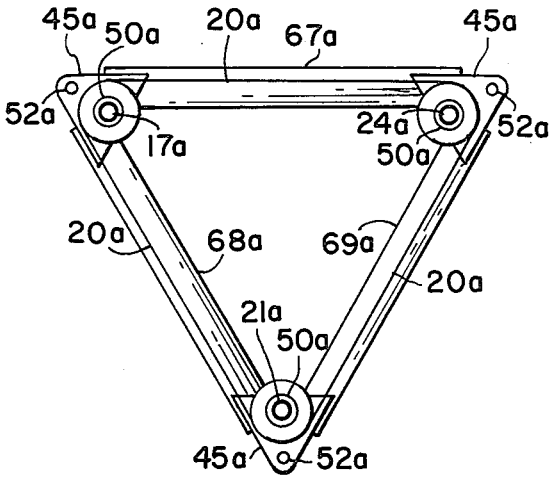
FIG. 7 is a base end view of the intermediate section of FIG. 5.

FIG. 7 shows a base end view of section 31. Note threaded holes 52*a* in lugs 45*a*. Holes 52*a* of lugs 45*a* threadingly engage screws 17*b*, 21*b* and 24*b* of the next outer section, intermediate section 32. Base end bushings 50*a* enable low friction rotation of screws 17*a*, 21*a* and 24*a* within lugs 45*a*. Screws 12*a*, 21*a* and 24*a* are precluded from sliding through lugs 45*a*.

Figure 8:
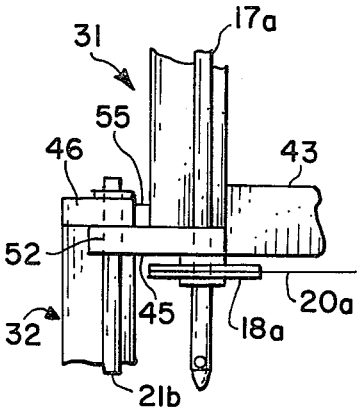
FIG. 8 is a detail view showing the corner of the interface of two sections in the fully extended position.

FIG. 8 illustrates the engagement of hole 52 of lug 45 of section 31 with screw 21*b* of section 32. Here, section 31 is shown in its fully extended position relative to section 32 and lug 45 is held tight against plate 46. A polished rubbing block 55 is attached to plate 46 to provide a low friction contact and alignment between sections 31 and 32.

Referring back to FIG. 2, in operation of the preferred embodiment of the invention, the column initially is in the fully collapsed position. This is the configuration of FIG. 2 except with lugs 45 of section 30 being in contact with lugs 45 of section 31. Motor 10 turns motor shaft 11 and drive sprockets 15 connected thereto thus, sprockets 14 are turned via chains 16.

Initially, clutches 12 are not engaged and screws 17 are mated with receivers 23. To initiate extension of the column clutch 12*a* is engaged thus turning screws 17*a* via engager 13*a*, receiver 23*a* and pins 22. Drive sprocket 18*a* turns chain 20*a* which turns sprocket 19*a* and screw 21*a*.

As screws 17*a* and 21*a* are turned, lugs 45 and section 30 are raised. When section 30 becomes fully extended, similar to the configuration of FIG. 8, clutch 12*a* is disengaged. Clutch 12*b* is now engaged resulting in the raising of section 31 in the above described fashion. Note that as section 31 is raised, screw 17*a*, being prohibited from sliding relative to section 31 by nuts 48*a*, is withdrawn from receiver 23*a*. When section 31 becomes fully extended, clutch 12 is disengaged. Each of the sections is thus raised in this fashion until the desired degree of extension is obtained. The selective clutch engagement may be accomplished manually or by the utilization of switches (not shown) positioned to activate clutch engagement and disengagement upon reaching a desired section extension.

The preferred embodiment of the invention as described hereinbefore includes five sections of equal length and being triangular in cross-section. These characteristics are illustrative only and do not limit the invention thereto. Any number of sections of any length may be used and the utilization of ten columns of equal length will accomplish an object of the invention of extensibility to ten times the original length. Any cross-section is possible, i.e., square, circular, rectangular, etc. In addition, the size of the sprockets may be varied to obtain the desired speed of erection or appropriate torque to supply desired lifting force. Recirculating ball type lugs and bushing and ball threaded screws may be used in place of conventional threads within the scope of the invention.

Semicircular tubing and angles were used as structural members for purposes of illustration. The invention is not limited thereto and any suitable shape, size or material of structural member may be used.

The above described description and drawings are only illustrative of a preferred embodiment which achieves the objects, features and advantages of the present invention, and it is not intended that the present invention be limited thereto. Any modifications of the present invention which come within the spirit and scope of the following claims are considered part of the present invention.

What is claimed as new and desired to be secured by Letters Patent of the United States is:

1. A telescoping column, having a base end and a tip end, comprising:

an outermost, an innermost, and at least one intermediate rigid structural sections nested within one another;

said outermost section and each of said at least one intermediate sections including a plurality of screws extending longitudinally therealong and rotatably attached thereto, said plurality of screws threadingly engaging an adjacent structural section and further including rotating means to selectively rotate said plurality of screws of said outermost and each of said at least one intermediate sections.

2. A telescoping column as in claim 1 wherein each of said at least one intermediate sections and said inner section includes a plurality of threaded lugs rigidly attached thereto and aligned to threadingly engage the plurality of screws of an adjacent structural section.

3. A telescoping column as in claim 2 wherein each of said plurality of screws of each of said sections extends past the base end thereof and one of said plurality of screws is a coupling screw being matingly attachable to said rotating means.

4. A telescoping column as in claim 3 wherein said inner section, each of said at least one intermediate section, and said outer section each is a right triangular configuration and wherein said plurality of screws of said inner section, said at least one intermediate section and said outer section consists of three screws, positioned to extend longitudinally along the edges thereof.

5. A telescoping column as in claim 4 further comprising a plurality of first sprockets rigidly attachable at the base end of said plurality of screws; a secondary chain engaging said plurality of said first sprockets and enabling simultaneous rotation of said plurality of screws.

6. A telescoping column as in claim 5 wherein said rotating means comprises:

a motor; and coupling means to selectively couple said motor with said plurality of screws to enable rotation thereof.

7. A telescoping column as in claim 6 wherein said coupling screw includes an elongated tip extending in the base end direction and having two pins protruding therefrom perpendicular to the axis of symmetry of said coupling screws; and wherein said coupling means comprises:

(a) a plurality of hollow cylindrical receivers for receiving said elongated tips of said coupling screws and having slots for receiving said pins and having tapered edges for guiding said pins into said slots;

(b) a plurality of clutches drivingly connected to said receiver and drivingly connected to said motor.

8. A telescoping column as in claim 7 wherein said coupling means further comprises a plurality of second sprockets, one rigidly attached to each of said plurality of clutches;

a shaft turned by said motor;

a plurality of third sprockets rigidly attached to said shaft and aligned with said plurality of second sprockets;

a plurality of chains each engaging one of said plurality of second sprockets to one of said plurality of third sprockets to drivingly interconnect said shaft to said plurality of clutches.

9. A telescoping column as in claim 1 wherein each of said structural sections further include:

semicircular longitudinal members oriented concave toward the longitudinal center of each of said structural sections;

angle beam base members rigidly attached perpendicularly to interjoin said longitudinal members at the base end thereof;

angle beam tip members rigidly attached perpendicular to interjoin said longitudinal members at the tip end thereof; and a plurality of braces each extending diagonally across the face of said structural section and having a first end thereof attached to an angle beam tip member and having a second end thereof attached to an angle beam base member.

* * * * *